United States Patent [19]

Vermeulen

[11] Patent Number: 4,705,925

[45] Date of Patent: Nov. 10, 1987

[54] KEY MODULE WITH KEY MEMBER RETAINED BY SWING MEMBERS

[75] Inventor: Ronny Vermeulen, Bellegem, Belgium

[73] Assignee: Siemens Aktiengesellschaft, Berlin and Munich, Fed. Rep. of Germany

[21] Appl. No.: 867,964

[22] Filed: May 29, 1986

[30] Foreign Application Priority Data

May 30, 1985 [DE] Fed. Rep. of Germany ..... 3519422

[51] Int. Cl.[4] ..... H01H 13/02; H01H 13/14

[52] U.S. Cl. ..... 200/340; 200/159 R; 200/159 B; 200/5 R; 200/281; 29/622

[58] Field of Search ..... 200/340, 159 B, 302.2, 200/5 A, 280, 5 R, 281, 159 R; 29/622

[56] References Cited

U.S. PATENT DOCUMENTS

| | | | |
|---|---|---|---|
| 3,098,141 | 7/1963 | Wintriss | 200/159 R |
| 3,829,646 | 8/1974 | Lorteije et al. | 200/159 B |
| 3,900,712 | 8/1975 | Fukao | 200/5 A X |
| 4,418,257 | 11/1983 | Muller et al. | 200/159 B |
| 4,641,004 | 2/1987 | Keprda | 200/340 |

FOREIGN PATENT DOCUMENTS

| | | | |
|---|---|---|---|
| 8334679 | 3/1984 | Fed. Rep. of Germany . | |
| 3241159 | 5/1984 | Fed. Rep. of Germany . | |
| 2113920 | 8/1983 | United Kingdom . | |
| 2140623 | 11/1984 | United Kingdom | 200/302.2 |
| 2140624 | 11/1984 | United Kingdom | 200/302.2 |

*Primary Examiner*—Henry J. Recla
*Assistant Examiner*—Ernest G. Cusick
*Attorney, Agent, or Firm*—Hill, Van Santen, Steadman & Simpson

[57] ABSTRACT

A bell or dome-shaped key member is formed of elastic material insertable into a plastic housing part which serves for fastening the key member to a contact plate. The key member is used for holding an actuation button. The key member is fixed in the plastic housing part via swing members which are of one piece integral construction with the plastic housing part and are attached thereto by film hinges. The swing members grasp the key member at a peripheral web at the contact plate side. In a free condition of the swing members, the key member can be inserted into the plastic housing part in unimpeded fashion. Subsequently, the swing members are moved into their retaining position and the key member is thereby locked in the plastic housing part.

6 Claims, 5 Drawing Figures

KEY MODULE WITH KEY MEMBER RETAINED BY SWING MEMBERS

BACKGROUND OF THE INVENTION

The invention relates to a key module or push button switch comprising a bell-shaped or dome-shaped key member formed of elastic material which has an edge limiting its open side. A plastic housing part is provided which partially accepts the key member and into which the key member can have its closed side previously inserted. Outwardly directed shoulders are provided on the key member in the proximity of the edge thereof which engage into recesses provided at right angles to the axis of the key member in the plastic housing part.

Such a key module is already known from German Utility Model No. 83 34 679, incorporated herein by reference. In this known key module, the shoulders which engage into recesses in the plastic housing part serve for the purpose of retaining the key member in the plastic housing part in an uncomplicated fashion. Thus, a composite member formed of the key member and plastic housing part which is simple to manipulate is formed.

In the mass production of such key modules, the insertion of the shoulders of the key member into the recesses of the plastic housing part is not simple, since the bell-shaped or dome-shaped key member formed of elastic material must be elastically deformed for this purpose.

SUMMARY OF THE INVENTION

It is an object of the present invention to improve a key module of the type initially cited such that the key member can be inserted into the plastic housing part unimpeded, i.e. without deforming it, and, after insertion, the key member forms a composite member together with the plastic housing part which can be manipulated in an uncomplicated fashion.

This object is achieved in accordance with the invention since limiting walls of the plastic housing part which grasp the shoulders of the key member at the open side of the key member are formed merely by swivel or swing members integrally connected to the plastic housing part via film hinges.

On the basis of this fashioning of the key module, only the swivel or swing members retain the key member in the plastic housing part opposite the insertion direction of the key member. In their free condition, i.e. when the key member is being inserted into the plastic housing part, these swivel members do not represent an impediment for the key member, and thus no deformation of the key member is required when the key member is inserted into the plastic housing part. Only after the insertion of the key member into the plastic housing part are the swivel members moved into the retaining position, and only then do they lock the key member in the plastic housing part.

In a further development of the invention, the shoulders of the key member are formed by a web which surrounds the key member in the proximity of its edge. The plastic housing part comprises an inside wall mated to this web and has a seating surface which acts as a stop when the key member is inserted into the plastic housing part.

In this way, the seating surface forms a retaining edge for the key member, whereby the inside wall automatically centers the key member in the plastic housing part, so that no additional techniques for aligning the key member and the plastic housing part to one another are required when the key member is inserted into the plastic housing part.

It can be further provided within the framework of the invention that the swivel members respectively movable in a plane parallel to the axis of the key member comprise retaining hooks which assume a parallel position relative to the seating surface of the inside wall in a locking position of the swivel members and, in this parallel position, have a distance from the seating surface of the inside wall which corresponds to the thickness of the web of the key member.

As a result thereof, the web of the key member is advantageously grasped in the axial direction of the key member only at sides lying opposite one another, and are thus grasped by the plastic housing part. The function of the key member is not deteriorated in any way whatsoever by the retention of the key member in the plastic housing part.

Finally, it can also be provided that the swivel members have projections engageable behind edges of the plastic housing part functioning as re-entrance hooks.

In this way, the swivel members are retained in their locking position in an uncomplicated fashion.

DESCRIPTION OF THE PREFERRED EMBODIMENTS

Figure 1:
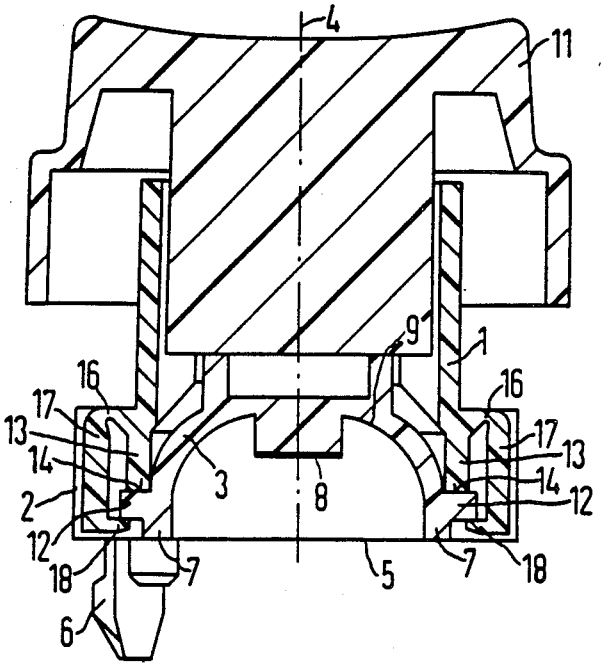
FIG. 1 illustrates a cross-section through the key module (push button switch) with the key cap or button in place.

It may be derived in detail from the drawing figures that the key module (push-button switch) comprises an essentially hollow-cylindrical plastic housing part 1 which merges into a roughly cuboid-shaped base 2 at that side which faces toward a contact plate (not shown). Proceeding from this side, a bell-shaped or dome-shaped key member 3 formed of elastic material is inserted into the plastic housing part 1. It is inserted such that the axes 4 of the plastic housing part 1 and of the key member 3 proceed coaxially relative to one another, and the open side 5 of the key member is facing toward the contact plate (not shown). When the key module formed of the key member 3 and the plastic housing part 1 is put in place on this contact plate, male retaining members 6 projecting from the base 2 of the plastic housing part 1 in the direction toward the contact plate penetrate into bores of the contact plate and firmly hold the key module at the contact plate. With the assistance of the plastic housing part 1, the key member 3 has an edge 7 which surrounds the open side 5 of the key member 3 pressed against the contact plate, and a contact space closed off from the surrounding environment is thus formed. Contact surfaces at the surface of the contact plate are situated in this contact space. These contact surfaces are capable of being connected to one another by a movable contact 8 secured to the cover 9 of the key member 3 concentrically with the axis 4. By actuating a key button 11 which is guided and held by the plastic housing part 1, the key member 3 can be collapsed. Thus, the movable contact 8 lays itself against the surface of the contact plate (not shown). When the key button 11 is released, then the key member 3 automatically re-assumes its original shape and thus also returns the key button 11.

When constructing keyboards, it is desirable to be able to handle the key module formed of key member 3 and plastic housing part 1 in common as a composite member, even though the key member 3 and plastic housing part 1 are parts that are manufactured separately from one another.

For a reliable connection between the key member 3 and the plastic housing part 1, the outside of the key member 3 is provided with a peripheral web or shoulder 12 in the proximity of its edge 7, this web or shoulder 12 being integrated as one integral piece with the key member 3. It projects from the key member 3 at a right angle relative to the axis 4. Mated to this web or shoulder 12 is the plastic housing part 1 having an inside wall 13 in the region of its base 2. The wall 13 comprises a seating surface 14 which faces the contact plate (not shown). Swivel or swing members 17 of one piece integral construction with the plastic housing part 1 via film hinges 16 are also provided at the base 2. They are respectively provided in the middle of the side walls 15 of the base which are directed away from the axis 4. At their free ends, the swivel or swing members 17, which respectively have their free ends movable in a plane parallel to the axis 4, include retaining hooks 18 which, in a locking position of the swivel members 17 as shown in FIG. 1 and FIG. 2, have a spacing from the seating surface 14 of the inside wall 13 which corresponds to the thickness of the material of the web 12.

Figure 2:
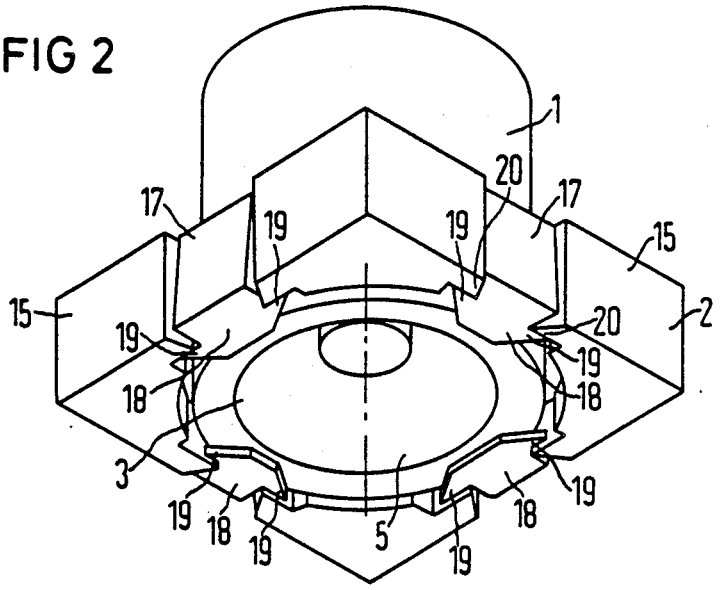
FIG. 2 shows the key module as seen obliquely from below.

As FIG. 2 shows, the swivel or swing members 17 comprise projections 19 in the region of their retaining hooks 18, these projections 19 placing themselves behind edges 20 (which proceed parallel to the axis 4) of the base 2 when the swivel members 17 are situated in their locking position. It may also be seen from FIG. 2 that the key member 3 is retained in the plastic housing part 1 at its open side 5 only by the retaining hooks 18 of the swivel members 17.

Figure 3:
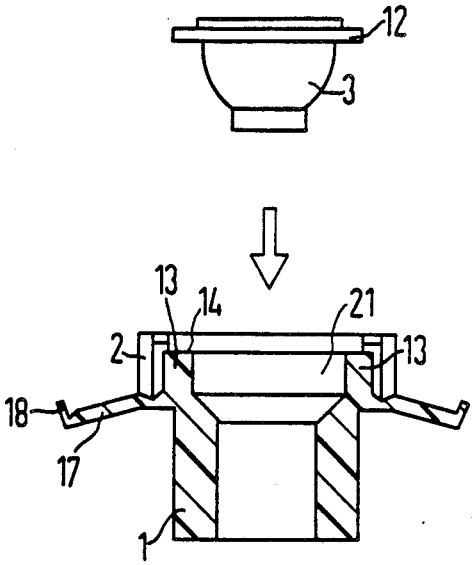
FIGS. 3, 4, and 5 illustrate the function of the swivel member upon insertion of the key member into the plastic housing part.
Figure 4:
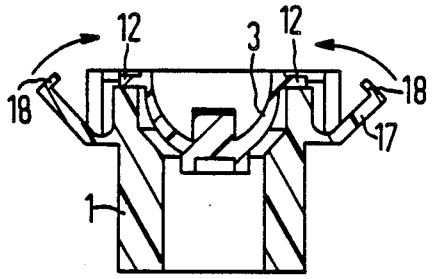
Figure 5:
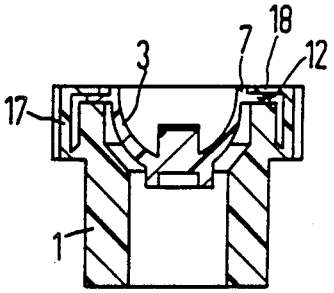

FIGS. 3 through 5 show how, before the insertion of the key member 3 into the plastic housing part 1, the swivel members 17 are initially in a free or unlocked condition in which the retaining hooks 18 leave the acceptance space 21 of the plastic housing part 1 for the key member 3 unimpeded. Under the influence of the force of gravity, the key member 3 therefore automatically falls into the acceptance space 21. The closed side of the key member 3 is downwardly directed in this case. In interaction with the web 12, the inside wall 13 of the base 2 automatically centers the key member 3 relative to the plastic housing part 1, and its seating surface 14 forms a retaining edge which acts as a detent for the key member 3 in the insertion direction.

When web 12 and inside wall 13 comprising the seating surface 14 lie against one another, the swivel or swing members 17 which are freely movable back and forth are brought into the locking position from the unlocked position. In this locking position (see, for example, FIGS. 1, 2 and 3 in this regard), the retaining hooks 18 of the swivel or swing members 17 are located at that side of the web 12 which faces away from the seating surface 14. As a result, the key member 3 is also fixed to the plastic housing part 1 in the direction facing away from the seating surface 14.

Although various minor changes and modifications might be proposed by those skilled in the art, it will be understood that I wish to include within the claims of the patent warranted hereon all such changes and modifications as reasonably come within my contribution to the art.

I claim as my invention:

1. A key module, comprising:

a dome-shaped key member formed of elastic material having a closed end and an open end limited by an edge;

a substantially hollow-cylindrical plastic housing part formed to accept said key member within one end thereof when said key member has its closed end inserted therein and wherein a longitudinal axis of said key member is coaxial with a longitudinal axis of said housing part;

an outwardly directed shoulder on said key member in a proximity of the edge at the open end thereof;

said shoulder comprising a web which surrounds said key member in a proximity of said edge;

said plastic housing part having an inside wall terminating in a seating surface which abuts against said web when the key member is seated within the housing part;

said plastic housing part having swing members freely movable back and forth between a locking and unlocked position, each being of integral one-piece construction with said housing part and which are attached to the housing part by integral film hinges;

said swing members being positioned and attached such that they swing in a plane parallel to the longitudinal axis of the housing part and havng retaining hooks which in the locking position have an engagement surface parallel to said seating surface of said inside wall and spaced from said seating surface by a thickness of said web of said key member, the retaining hooks engaging said web when said key member is inserted in the housing part; and said retaining hooks of said swing members each having projection means for engagement with edges of said plastic housing part so as to retain said retaining hooks in said locking position.

2. A key module according to claim 1 wherein said seating surface abuts said web at a side of the web opposite said open end and the retaining hooks engaging a side of said web facing said key member open end.

3. A key module according to claim 1 wherein a key button has a portion received within the plastic housing part at one end thereof and the key member is received within the plastic housing part at an opposite end thereof.

4. A key module, comprising:

a dome-shaped key member formed of elastic material having a closed end and an open end, an outwardly directed peripheral shoulder being provided on said key member adjacent said open end;

a plastic cylindrical housing part having a central hollow, and at one end of the housing part an inside wall being provided having a seating surface at one end thereof, and swing members freely movable back and forth between a locking and unlocked position being provided adjacent said inside wall attached by flexible hinges to said housing part; and said dome-shaped key member being received in said one end of said hollow such that a surface of said peripheral shoulder facing the closed end of the dome-shaped key member abuts said seating surface and wherein the swing members when swung into said locking position, engage a side of said peripheral shoulder facing said key member open end.

5. A key module according to claim 4 wherein a key button is provied and a portion thereof is received within one end of said central hollow, opposite said one end of the central hollow which receives said key member.

6. A key module, comprising:

a dome-shaped key member formed of elastic material having a closed end and an open end limited by an edge, an outwardly projecting shoulder being provided adjacent said open end;

a hollow plastic housing part having a central hollow, and at one end of said housing part swing members freely movable back and forth between a locking and unlocked position being provided having associated retaining hooks; and said key member being received at said one end in said central hollow of the housing part closed end first, and such that said closed end lies within the central hollow, and wherein a surface of said outwardly projecting shoulder facing said open end of the key member is engaged by the retaining hooks of the swing member.

* * * * *